US007497435B2

(12) United States Patent
Chastain et al.

(10) Patent No.: US 7,497,435 B2
(45) Date of Patent: Mar. 3, 2009

(54) BACKING PLATE SUPPORT SYSTEM FOR A MAILPIECE FEEDER

(75) Inventors: David P. Chastain, Clarks Hill, IN (US); David W. Purcell, Crawfordsville, IN (US); Adam W. Fleming, Otterbein, IN (US)

(73) Assignee: Pitney Bowes Inc., Stamford, CT (US)

( * ) Notice: Subject to any disclaimer, the term of this patent is extended or adjusted under 35 U.S.C. 154(b) by 376 days.

(21) Appl. No.: 11/317,434

(22) Filed: Dec. 23, 2005

(65) Prior Publication Data

US 2007/0145673 A1 Jun. 28, 2007

(51) Int. Cl.
*B65H 1/02* (2006.01)

(52) U.S. Cl. ..... 271/150; 271/149; 271/271; 271/190

(58) Field of Classification Search ..... 271/149, 271/150, 190, 271
See application file for complete search history.

(56) References Cited

U.S. PATENT DOCUMENTS 1,228,898 A * 6/1917 Frank ..... 5/289
2,847,213 A * 8/1958 Duncanson et al. ..... 271/150
3,647,203 A * 3/1972 De Hart ..... 271/31.1
3,902,587 A * 9/1975 Checcucci ..... 198/419.3
4,007,824 A * 2/1977 Reist ..... 198/462.2
4,052,052 A * 10/1977 Muller ..... 271/157
4,167,227 A * 9/1979 Pichon et al. ..... 198/456
4,443,007 A * 4/1984 Adamoski et al. ..... 271/269
5,335,899 A * 8/1994 Golicz ..... 271/34
5,379,992 A * 1/1995 Holmes et al. ..... 271/2
5,476,254 A * 12/1995 Golicz ..... 271/10.05
5,657,982 A * 8/1997 Holmes et al. ..... 271/149
6,446,955 B1 * 9/2002 Janatka et al. ..... 271/96
6,467,768 B1 * 10/2002 Vary et al. ..... 271/150
6,629,691 B2 * 10/2003 Niiyama et al. ..... 271/2
2003/0141166 A1 * 7/2003 Hoveling ..... 198/618
2004/0256788 A1 * 12/2004 Pittelkow ..... 271/113

* cited by examiner

*Primary Examiner*—Patrick H Mackey
*Assistant Examiner*—Howard Sanders
(74) *Attorney, Agent, or Firm*—Brian A. Collins; Angelo N. Chaclas

(57) ABSTRACT

A backing plate support system is provided for a mailpiece feeder mechanism wherein mailpieces are conveyed vertically, on-edge along a transport deck to a transfer station for subsequent sortation and delivery. The backing plate support system includes a guide track disposed along and adjacent to the transport deck and a plurality of backing plates each having a guide support fitting at its base. The guide support fitting engages the guide track and supports the backing plate in an orthogonal position relative to the transport deck. The backing plate support system, furthermore, includes an advancing belt disposed adjacent the guide track and adapted to be driven linearly along the transport deck and a mechanism for coupling each backing plate to the advancing belt. The mechanism facilitates relative movement of the backing support plate relative to the advancing belt in one direction while inhibiting relative motion thereof in an opposing direction. Furthermore, the mechanism facilitates optimum spacing between pairs of backing plates when mailpieces are stacked therebetween by a system operator. In one embodiment of the invention, a controller is operable to preposition each of the backing plates such that the operator may stack mailpieces against one backing plate and, on the command of the operator, introduce a second backing plate to support any thickness of stacked mailpieces.

19 Claims, 10 Drawing Sheets

BACKING PLATE SUPPORT SYSTEM FOR A MAILPIECE FEEDER

TECHNICAL FIELD

The present invention relates generally to mailpiece feeders, and, more particularly, to a new and useful mailpiece feeder having an on-demand backing plate support system, which facilitates stacking/feeding large quantities of letter-size/flats mailpieces, optimizes throughput efficiency, and minimizes handling malfunctions.

BACKGROUND OF THE INVENTION

Mailpiece feeders are commonly employed in high-output mailpiece sorters demanding a steady, high-input flow of mailpieces for efficient operation. Therein mailpieces are generally stacked in an up-right position, i.e., on-edge, on a transport deck and shuttled toward a take-out station where the mailpieces are singulated and sorted into one of a myriad of sorting bins/containers. Furthermore, two or more paddles or separator plates may be employed to define compartments therebetween to maintain the on-edge, vertical orientation of the juxtaposed on-edge mailpieces.

Tomiyama et al. U.S. Pat. No. 6,158,732 discloses a sheet feeder for feeding mailpieces in an "upright posture" along a mounting table to a take-out section. More specifically, the mounting table includes a transfer section comprising a plurality of spaced-apart plates or paddles containing a plurality of mailpieces. The paddles, furthermore, are driven linearly along a track which, in turn, moves the mailpieces toward the take-out section of the feeder. The paddles form vertical stanchions/supports i.e., functioning as bookends, to maintain the up-right orientation of the mailpieces as they slide along a linear feed path. While the vertical paddles/plates function admirably to maintain the vertical posture of the mailpieces, the relative spacing therebetween is fixed/constant. Accordingly, unless the combined thickness of the mailpieces equals the dimension between a pair of paddles or, alternatively, is a multiple thereof (when two or more mailpiece compartments are employed), the mailpieces may fill the compartments in a non-optimum manner. That is, either all of the compartments will be slightly under-filled/over-filled, or at least one compartment will only be partially-filled.

Inasmuch as the operation of the take-out section is particularly sensitive to the orientation of, and pressure applied by, the fed mailpieces, any misalignment of the mailpieces or retarding force, can result in a feed failure. For example, a partially-filled compartment may result in a sag/bow in flats mailpieces when standing on-edge. As such, the mailpieces may be fed at an oblique angle, deviating significantly from the desired planar orientation. On the other hand, an over-filled compartment can result in difficulties separating and/or singulating the mailpieces. That is, high friction forces can develop between the mailpieces as the spring stiffness characteristics of the paddles/plates tend to squeeze the mailpieces therebetween. As such, the friction forces retard or otherwise restrict the release of the mailpieces which may adversely impact mailpiece separation/singulation by the take-out belt. It should be appreciated that the take-out belt relies on a known/expected magnitude of friction to remove or separate one mailpiece from another. Consequently, "fixed-pitch" paddles or separation devices often result in the mailpieces being under-filled or over-filled, and exhibit feed failure difficulties such as those described above. Examples of other fixed-pitch separation devices are disclosed in Noguchi et al. U.S. Pat. No. 4,789,148, and Hiromori et al. U.S. Pat. No. 4,523,753.

With regard to the paddle/plate shown in the Tomiyama '732 patent, it will also be recognized that the paddle/plate is adapted to support small, letter-size envelopes or post-card sized sheets. In view of the sensitivity of mailpiece feeders to deviations in mailpiece shape and size, the teachings of the '732 patent are not immediately/directly applicable to full-sized flats-type mailpieces or letter-sized sheet material. That is, the paddle configuration will almost assuredly result in a malfunction when handling/supporting mailpieces which are oversized relative to the paddle, i.e., the unsupported section of the mailpiece potentially resulting in a non-planar orientation.

A variable pitch separation device is disclosed in Antonelli et al. U.S. Patent Application Publication No. US 2004/0113355 A1 wherein a single wedge-shaped blade supports a vertical mail stack of an on-edge mail stacker. The wedge-shaped blade is slideably mounted to and guided by a linear support or bar. Furthermore, the blade is pivotable about the longitudinal axis of the bar so that an operator can rotate the blade upwardly to remove it from the vertical mail stack at a first location and downwardly again to support the mail stack at a second location. While the wedge-shaped blade may be variably positioned relative to the mail stack, the blade is a passive device which slides along the transport deck as additional mailpieces are added to the stack. Furthermore, the blade is generally configured to support letter size envelopes along the long edge of the mailpiece. Moreover, the support system disclosed therein provides a single compartment, i.e., between the single blade and the input belt. Consequently, the single passive blade provides nominal control over the frictional forces developed between the mailpieces and is not configured to support larger, flats mailpieces.

A need, therefore, exists for a mailpiece feeder which minimizes handling malfunctions, optimizes throughput efficiency, and facilitates the stacking/feeding of large quantities of letter-size and flats mailpieces.

SUMMARY OF THE INVENTION

A backing plate support system is provided for a mailpiece feeder mechanism wherein mailpieces are conveyed vertically, on-edge along a transport deck to a transfer station for subsequent sortation and delivery. The backing plate support system includes a guide track disposed along and adjacent to the transport deck and a plurality of backing plates each having a guide support fitting at its base. The guide support fitting engages the guide track and supports the backing plate in an orthogonal position relative to the transport deck. The backing plate support system, furthermore, includes an advancing belt disposed adjacent the guide track and adapted to be driven linearly along the transport deck and a mechanism for coupling each backing plate to the advancing belt. The mechanism facilitates relative movement of the backing support plate relative to the advancing belt in one direction while inhibiting relative motion thereof in an opposing direction. Furthermore, the mechanism facilitates optimum spacing between pairs of backing plates when mailpieces are stacked therebetween by a system operator. In one embodiment of the invention, a controller is operable to preposition each of the backing plates such that the operator may stack mailpieces against one backing plate and, on the command of the operator, introduce a second backing plate to support any thickness of stacked mailpieces.

BEST MODE TO CARRY OUT THE INVENTION

The backing plate support system of the present invention is described in the context of a mailpiece feeder. It should be appreciated, however, that the backing plate support system is equally applicable to any sheet or mailpiece conveyance system wherein the orientation of delivery is preferably on-edge or vertical, i.e., as the sheet/mailpiece moves from one station to another. Before discussing the operation of the backing plate support system, it is useful to understand the basic operation of a mailpiece feeder including the cooperation of the various components and system elements.

Figure 1:
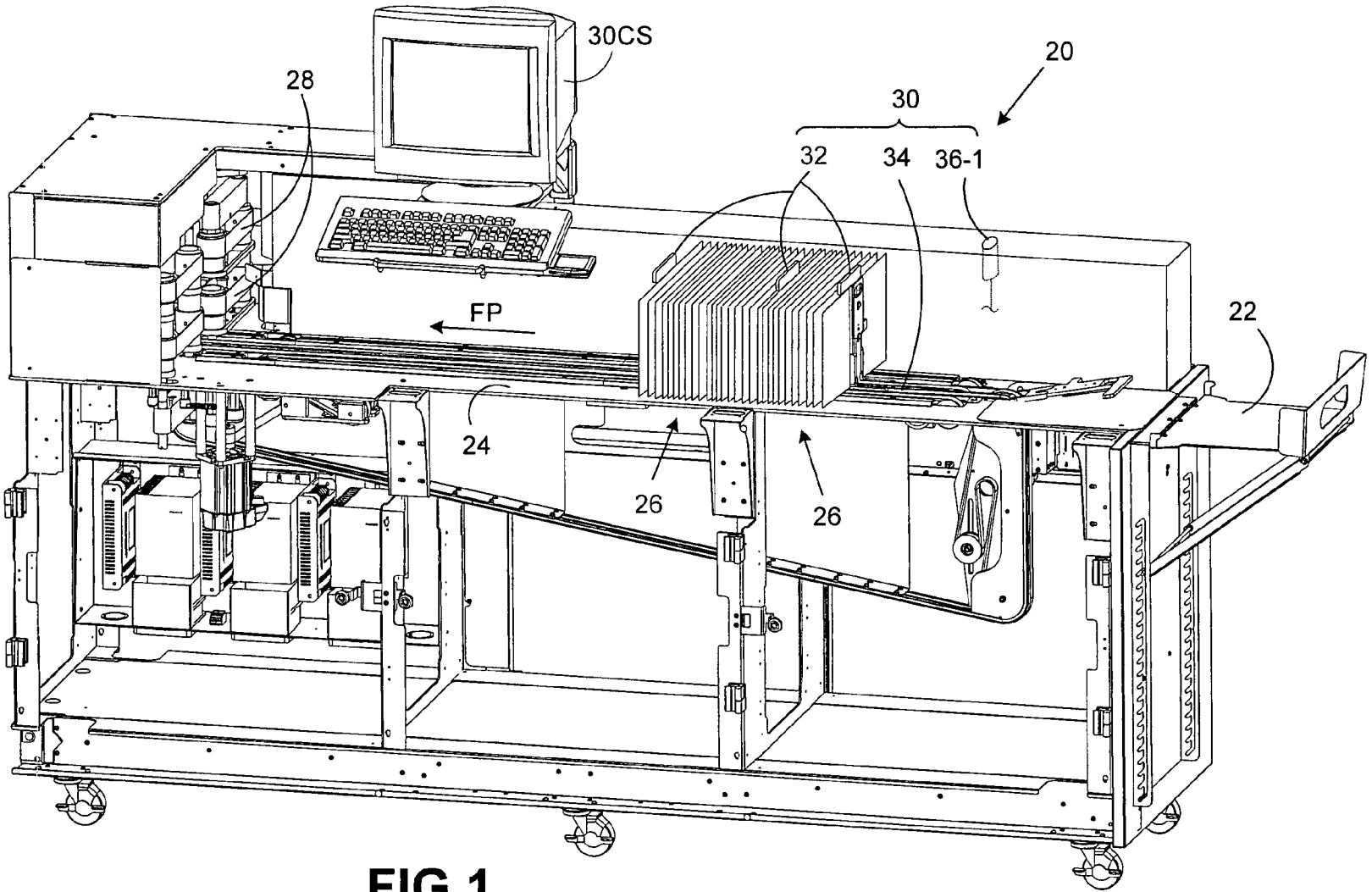
FIG. 1 depicts a perspective view of a mailpiece feeder having an on-demand backing plate support system according to the present invention.

In FIG. 1, the mailpiece feeder 20 includes a tub shelf 22, a transport deck 24 defining a feed path FP for conveyance of a plurality of mailpieces 26, and transfer feed belts 28 for singulating the mailpieces 26 i.e., separating the mailpieces 26 one-by-one, and removing each from the transport deck 24 to a system (not shown) of sortation bins. In order for the transfer belts 28 to properly separate and singulate the mailpieces 26, it is necessary to orient each mailpiece 26 vertically on-edge. In accordance with the various objectives of the invention, the mailpiece feeder 20 is adapted to handle a variety of mailpiece configurations including magazines, newspapers, newsletters, conventional letter-size envelopes and full-size flats envelopes, e.g., corresponding to a full size unfolded sheet of letter/A4 paper. Furthermore, the mailpiece feeder 20 is adapted to transport the vertically oriented mailpieces 26 without introducing adverse forces, e.g., applied pressure, which may interrupt the separation of the mailpieces 26 or effect a malfunction of the transfer belts 28. Additionally, the stacking and control of the mailpiece feeder 20 must minimize operator workload to optimize mailpiece throughput.

To achieve these and other objectives, an inventive backing plate support system 30 includes a plurality of backing plates 32 projecting orthogonally from a central advancing belt 34. The backing plates 32 are supplied, on-demand, in response to an input signal from an optical sensor 36 mounted to an upper horizontal deck 38. Moreover, a first optical sensor 36-1 is disposed proximal to the tub shelf 22 and within reach of an operator (not shown) whose principle function is to load mailpieces between pairs of backing plates 32. A second optical sensor 36-2 is disposed in combination with the transfer belt assembly 28 to drive the central advancing belt 34. As will be discussed in greater detail hereinafter, these optical sensors 36-1, 36-2 issues drive signals to one or more rotary drive motors to drive the backing plates 32 along various sections of the backing plate support system 30.

Figure 2:
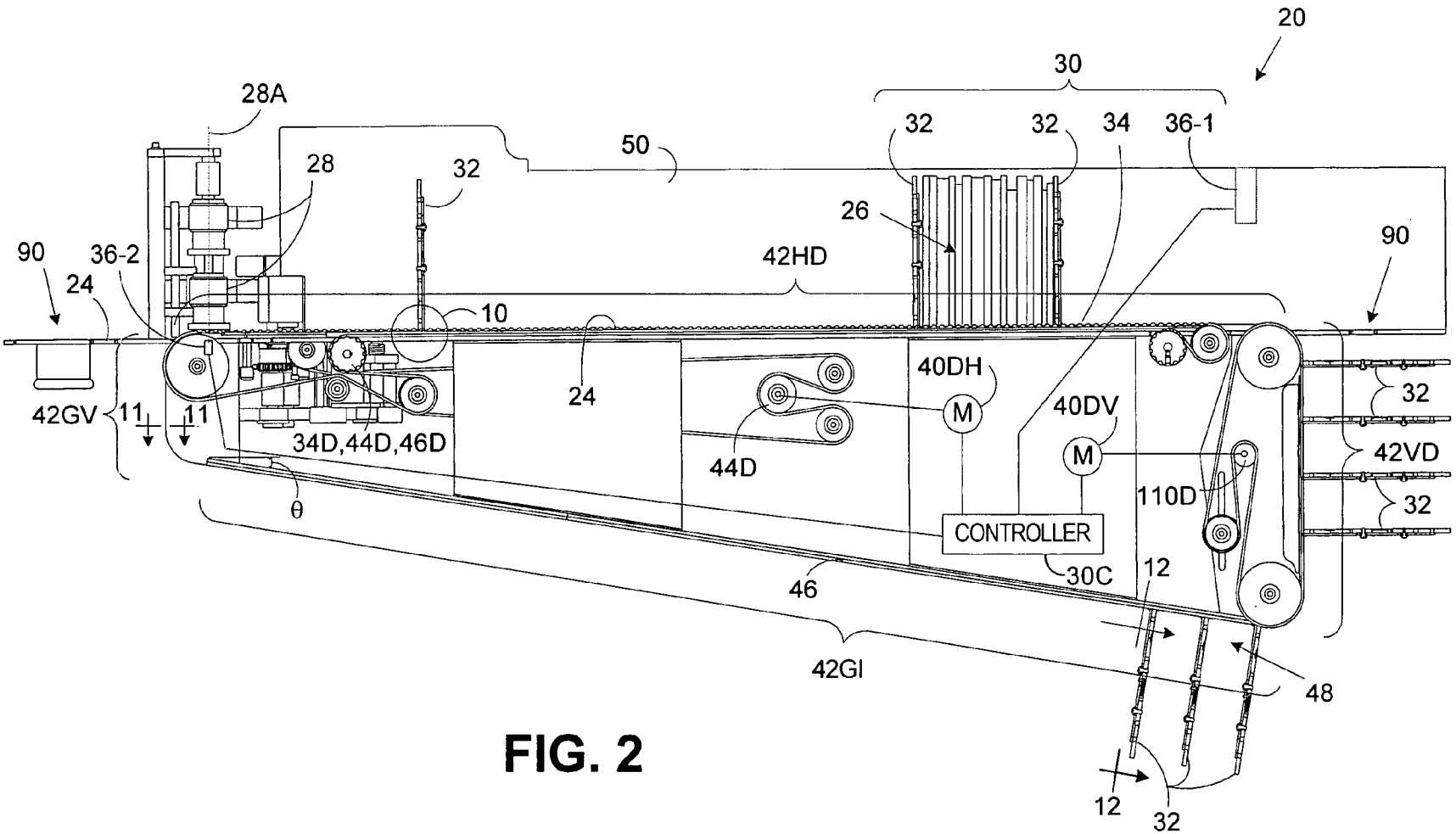
FIG. 2 is a front view of the backing plate support system including a plurality of backing plates driven by a central advance belt, an on-demand advance sensor for activating and driving the central advance belt, and a vertical drive assembly for pre-positioning a backing plate in response to the on-demand advance sensor.

In FIG 2, the backing plate support system 30 drives a total of ten (10) backing plates 32 about a closed-loop track, although the track may be viewed as including four (4) discrete sections 42HD, 42GV (FIG. 2 shows 42GF), 42GI (FIG. 2 shows 42IP and 42VD). A horizontal drive section 42HD conveys mailpieces 26 (i.e., a stack of mailpieces disposed between pairs of backing plates 32) to the transfer belts 28. A first gravity fed section 42GV allows the backing plates 32 to fall vertically below the transport deck 24 to a second gravity-fed section 42GI of the track. There, the backing plates 32 ride, under the force of gravity, down an inclined plane or gradually sloping track 46 to a queuing station 48. From the queuing station 48, the backing plates 32 are driven vertically upward along the vertical drive section 42VD, through the transport deck end back, once again, to the horizontal drive section 42HD.

In the described embodiment, Therefore, it will be appreciated that drive motors 40DH, 40DV are employed for driving the backing plates 32 along two sections of the closed-loop track, i.e., the horizontal and vertical drive sections 42HD, 42VD of the track. Furthermore, a first of the rotary drive motor 40DH 40DV is responsive to operator input commands issued by the first optical sensor 36-1 while a second rotary drive motor 40DH is responsive to system input commands issued by the second optical sensor 36-2. The function and sequence of operation of the backing plate support system 30 will become apparent when discussing the detailed operation of the mailpiece feeder.

Figure 3:
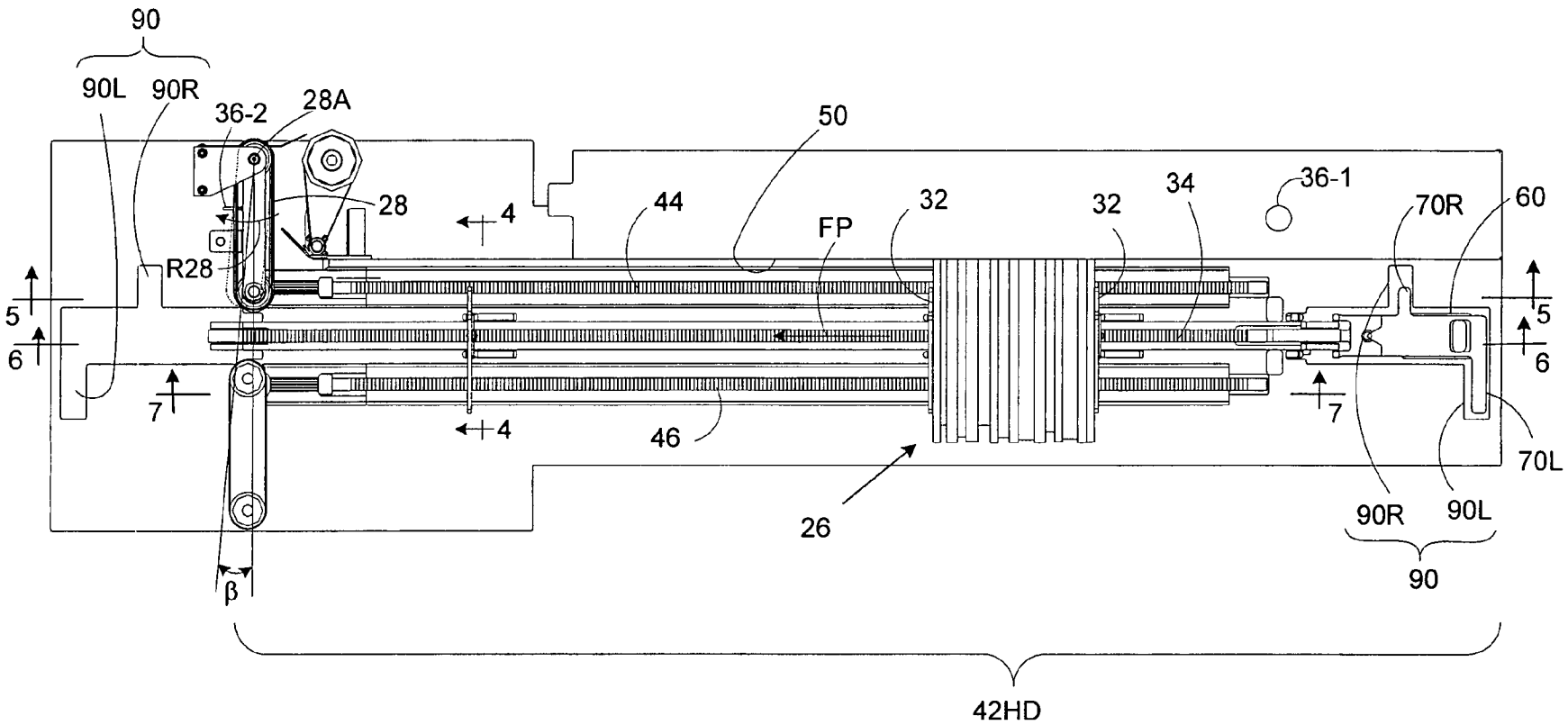
FIG. 3 is a top view of the backing plate support system illustrating the central advance belt disposed between inboard and outboard feed magazine belts for conveying stacks of on edge mailpieces toward vertically oriented pre-feed belts for separating, singulating and delivering individual mailpieces to subsequent processing stations.
Figure 4:
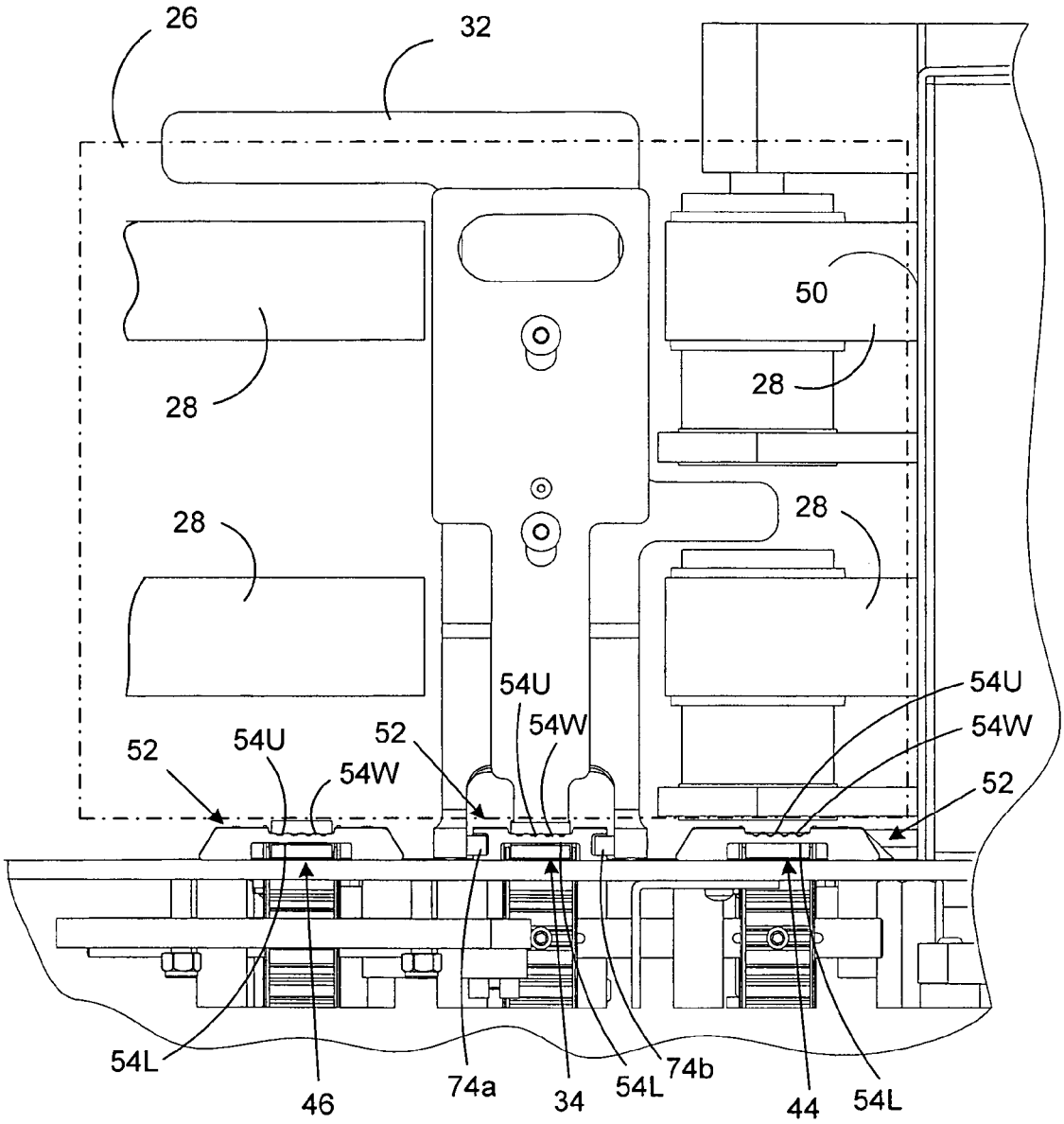
FIG. 4 is a cross-sectional view taken substantially along line 4-4 of FIG. 3 illustrating the path of the inboard feed magazine belt.

In FIGS. 2, 3, and 4, the horizontal drive section 42HD includes inboard and outboard feed magazine belts 44, 46 disposed to each side of the central advance belt 34. More specifically, the inboard feed belt 44 (see FIGS. 3 and 4) is disposed proximal to a registration wall 50 of the mailpiece feeder 20 along which a vertical edge of each mailpiece 26 is guided, i.e., as the mailpiece stack 26 is conveyed along the feed path FP. The outboard feed belt 46, on the other hand, is disposed nearest an operator (not shown) loading the mailpieces 26 on the belts 44, 46. The belts 34, 44, 46 are each guided by an H-shaped guide plate 52 (See FIG. 4) which provides low-friction channels 54U, 54L for guiding each of the belts 34, 44, 46. That is, each of the belts 34, 44, 46 seats within the upper guide channel 54U, wraps around/traverses several redirecting/guide/drive wheels, and returns via the lower guide channel 54L.

Figure 5:
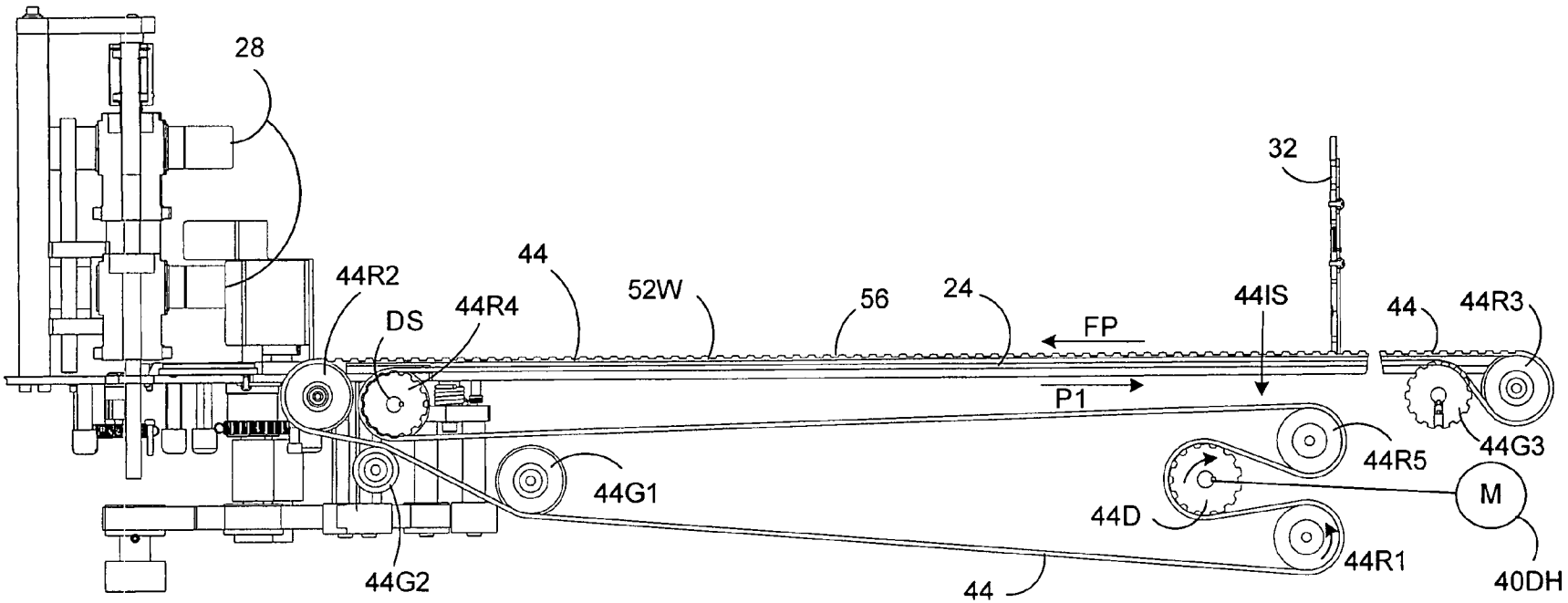
FIG. 5 is a cross-sectional view taken substantially along line 5-5 of FIG. 3 illustrating the path of the central advancing belt.
Figure 6:
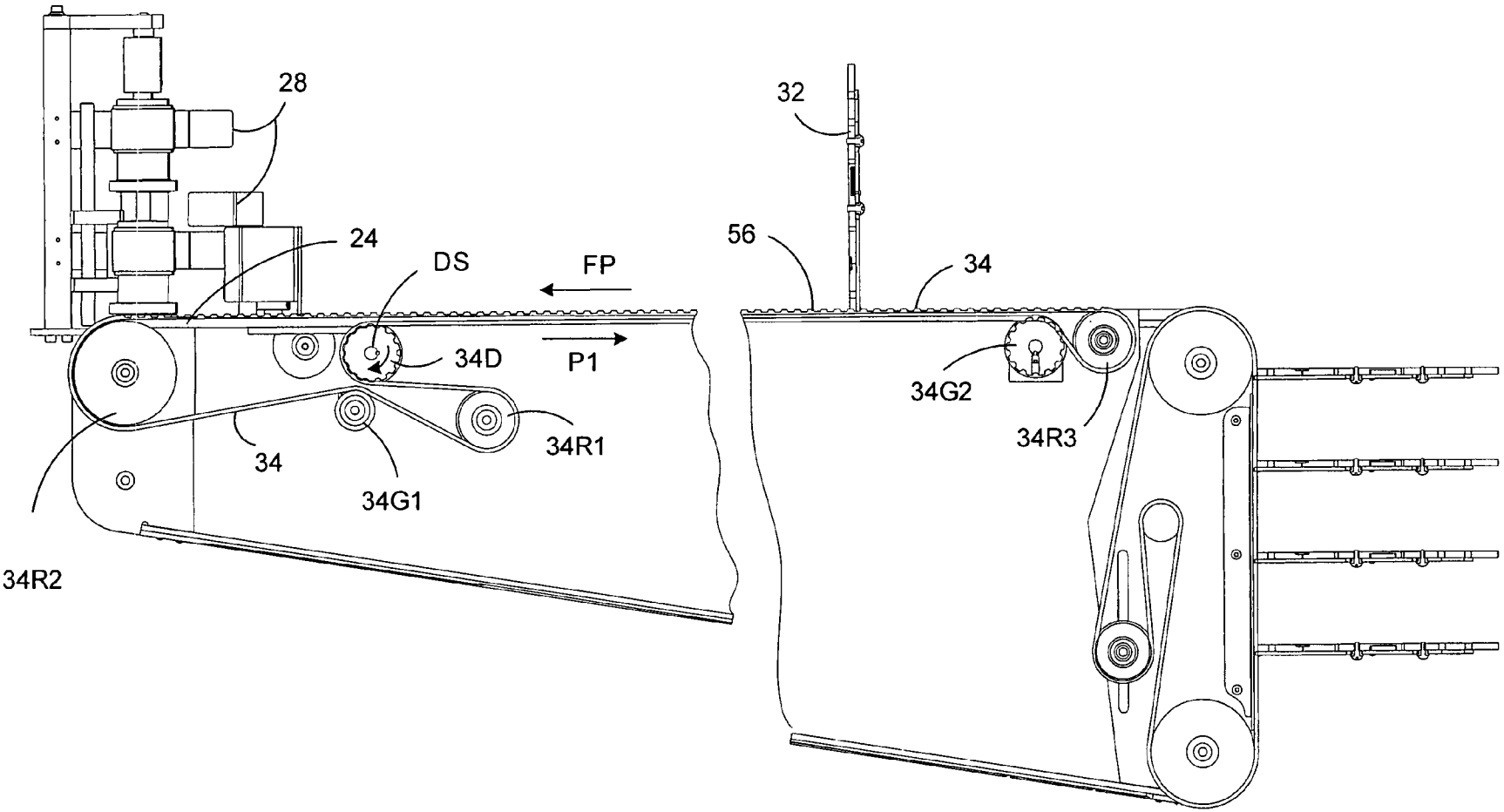
FIG. 6 is a cross-sectional view taken substantially along line 6-6 of FIG. 3 illustrating the path of the outboard feed magazine belt.
Figure 7:
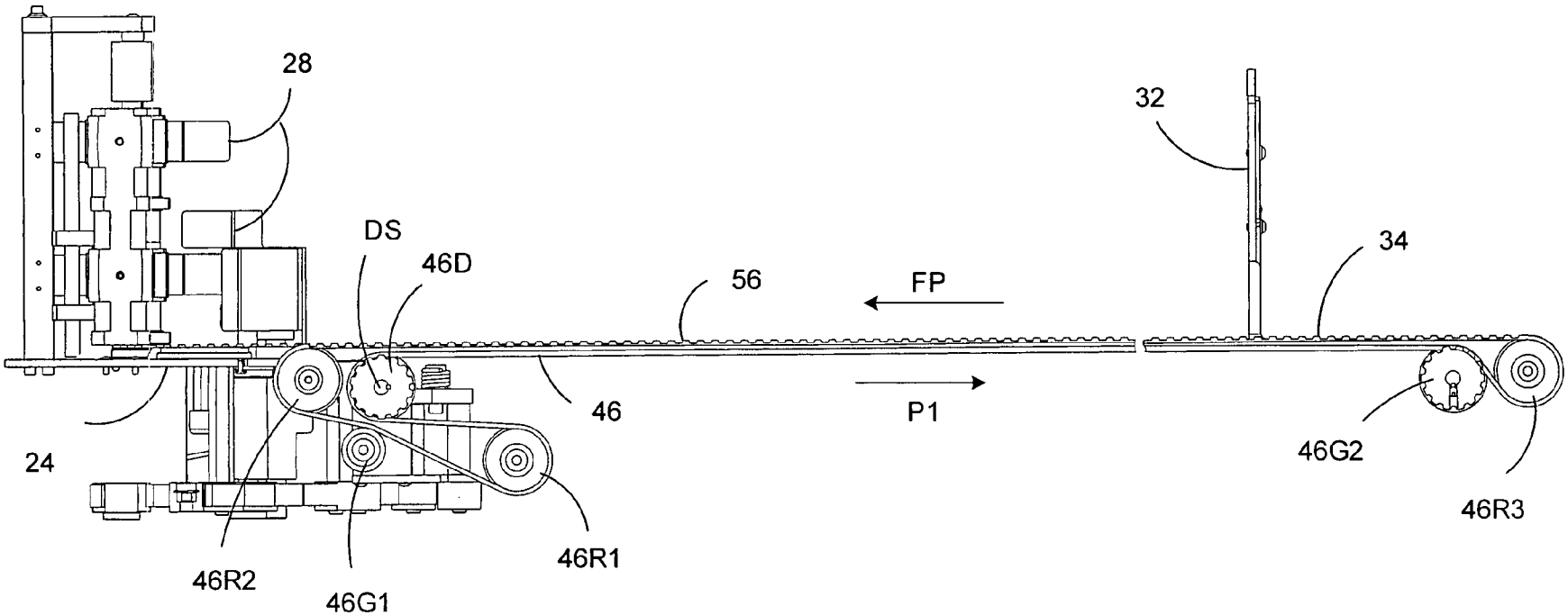
FIG. 7 is a cross-sectional view taken substantially along line 7-7 of FIG. 3 illustrating H-plates mounted to the transport deck for guiding the backing plates, the advancing belt and the feed magazine belts, i.e., inboard and outboard belts.

The path traversed by each belt is best understood by reference to FIGS. 5, 6 and 7 which shows sectional views through each of the belts 34, 44, 46. In FIG. 5, a drive motor 40DH is rotationally coupled to an input drive portion 44IS of the inboard feed magazine belt 44. More specifically, a primary drive gear 44D rotates in a clockwise direction causing first and second redirecting wheels 44R1—(also serves to apply tension to the belt 44), 44R2 to rotate in a counterclockwise direction. The first redirecting wheel 44R1 may be adapted to apply tension to the belt 44 and the second redirecting wheel 44R2 is disposed downstream of the mailpiece input/operator workstation and proximal to the transfer belts 28. Between the redirecting wheels 44R1, 44R2, are a pair of guide wheels 44G1, 44G2 which function to directs the belt 44 above/around other system critical components and facilitate loading and tensioning of the inboard feed magazine belt 44. As the belt 44 wraps around the second redirecting wheel 44R2, it passes through the transport deck 24 and is pulled through the upper channel of the respective H-bridge 52 (shown in FIG. 4) in the direction of the mailpiece feed path FP. At an upstream location, i.e., proximal to the mailpiece input station, the belt 44 is redirected below the transport deck 24 by a third redirecting wheel 44R3. The third guide wheel 44G3 then directs the belt 44 through the lower channel 54L (see FIG. 4) of the H-bridge 52 which is disposed between a web portion 52W of the H-bridge 52 and the upper surface of the transport deck 24. Consequently, the belt 44 is pulled through the lower channel 54L in the direction of arrow P1 (FIG. 5) opposite the direction of the mailpiece feed path FP. The belt 44 then returns downstream to wrap around a forth redirecting wheel 44R4, which also serves as a common input drive shaft DS for the two adjacent belts, i.e., the advancing belt 34 and the outboard feed magazine belt 46, To complete the path, the belt 44 wraps around a fifth and final redirecting wheel 44R5 which may also be spring loaded to apply tension to the belt 44.

In FIG. 6, the advancing belt 34 is driven by en input drive wheel 34D which is driven by the shaft DS in common with the forth redirecting wheel 44R4 (See FIG. 5) of the inboard feed magazine belt 44. More specifically, the input drive wheel 34D rotates in a clockwise direction to cause first and second redirecting wheels 34R1 (also serves to apply tension to the belt 34), 34R2 to rotate in a counterclockwise direction. The first redirecting wheel 34R1 may be adapted to apply tension to the belt 34 and the second redirecting wheel 34R2 is disposed downstream slightly past the transfer belts 28 of the mailpiece feeder 20. Between the redirecting. wheels 34R1, 34R2 is a guide wheel 34G1 which serves to direct the belt 34 above/around other system components apply tension to the advancing belt 34. As the belt 34 wraps around the second redirecting wheel 34R2, it passes through the transport deck 24 and is pulled through the upper channel 54U of the respective H-bridge 52 (FIG. 4) in the direction of the feed path FP. Upstream of the transfer belts 28, the advancing belt 34 is redirected below the transport deck 24 by a third redirecting wheel 34R3 and directed through the lower channel 54L of the H-bridge 52 by a second guide wheel 34G2. Consequently, the belt 34 is pulled through the lower channel 54L in the direction of arrow P1 opposite the direction of the mailpiece feed path FP. The advancing belt 34 then returns downstream connecting to the input drive wheel 34D thereby completing the belt path.

FIG. 7, the outboard feed magazine belt 46 is driven by an input drive wheel 46D which is driven by the shaft DS in common with the forth redirecting wheel 44R4 (See FIG. 5) of the inboard feed magazine belt 44. Similar to the advancing belt 34, the outboard feed magazine belt 46 wraps around first and second redirecting wheels 46R1 (also serves to apply tension to the belt 34), 46R2, extends through the transport deck 24 and seats within the upper channel 54U (FIG. 4) of the respective H-bridge guide 52. Between the first and second redirecting wheels 46R1, 46R2 is a first guide wheel 46G1, disposed between the first and second redirecting wheels 46R1, 46R2, which directs the belt 46 above/around other system critical components serves to apply tension to the belt 46. At an upstream location, the outboard feed magazine belt 46 drops below the transport deck 24, wraps around a third redirecting wheel 46R3 and is guided by a second guide wheel 46G2 into the lower channel 54L of the H-bridge guide 52. The belt 46 then extends the length of the transport deck 24 to the drive wheel 46D.

The primary drive motor 40DH propels all three of the belts 34, 44 and 46 at the same linear velocity along the transport deck 24 That is, inasmuch as all belts 34, 44 and 46 are driven by a common shaft DS having equal diameter drive wheels 34D, 44D and 46D, each of the belts 34, 44, 46 traverse the transport deck 24 at the same velocity. In the described embodiment, all of the belts 34, 44, 46 include teeth 56 on at least one side thereof for engaging the teeth of a respective drive wheel 34D, 44D or 46D.

Figure 8:
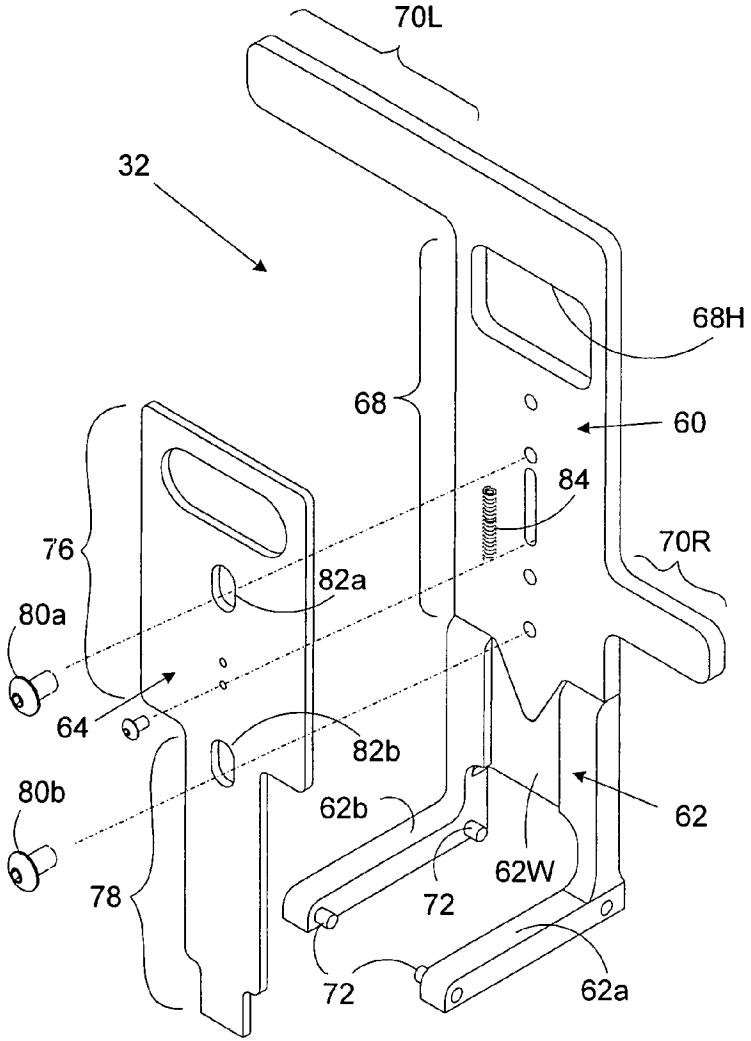
FIG. 8 is an exploded perspective view of a backing plate shown in FIG. 3

In addition to being driven by the teeth 56, the teeth 56 of the advancing belt 34 serve to engage, position and advance/transport each backing plate 32 along the mailpiece feed path FP. More specifically, and referring to FIGS. 8, 9 and 10, each backing plate 32 includes a mailpiece support portion 60, a guide support fitting 62 disposed in combination with the mailpiece support portion 60 and a resilient locking plate 64 mounting to a face surface 62S of the mailpiece support portion 60. The mailpiece support portion 60 is affixed, e.g., bonded, welded etc., to an upper end of the support fitting 62 and includes a central plate segment 68 having a substantially rectangular aperture 68O formed through an upper end portion of the central plate segment 68.

Figure 9:
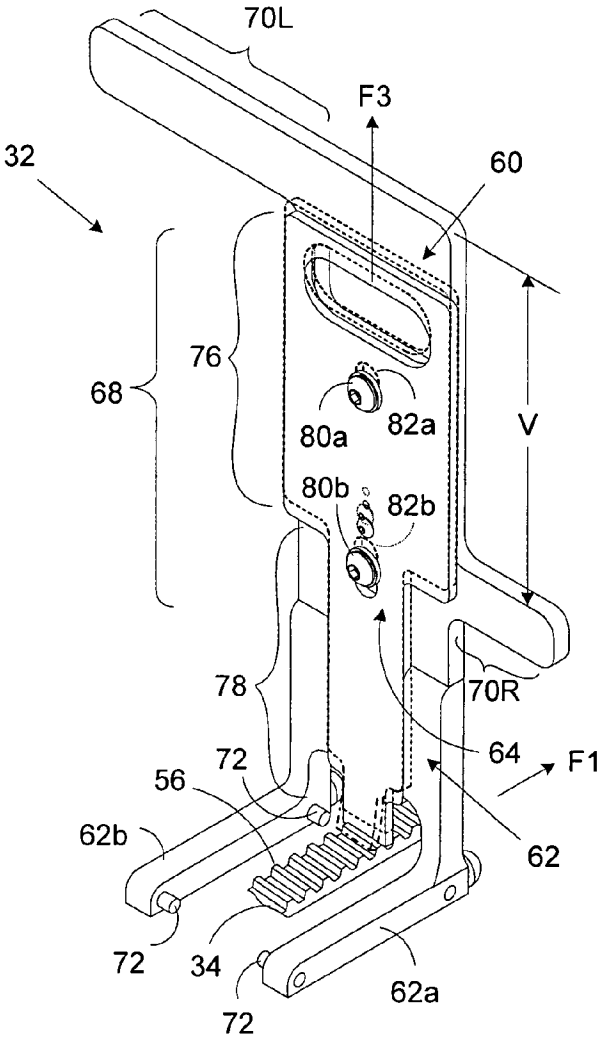
FIG. 9 is an isolated perspective view of a backing plate in combination with a base guide fitting for engaging a guide track of the H-plate.
Figure 10:
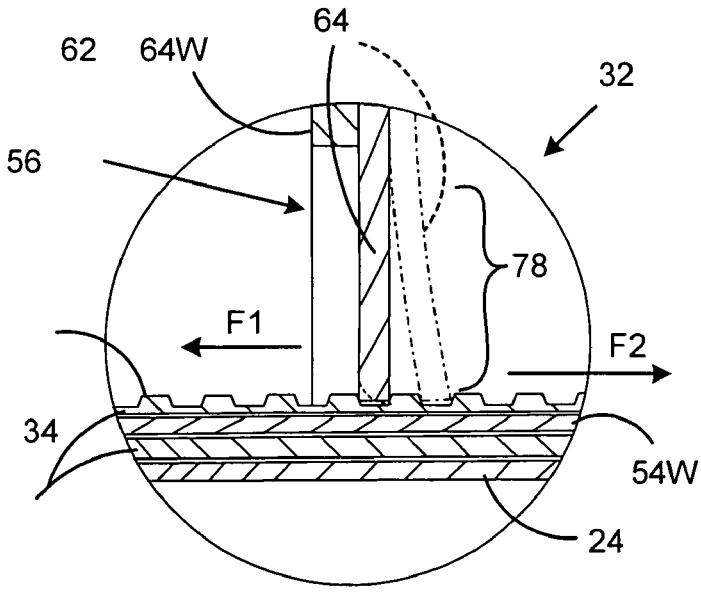
FIG. 10 is a perspective view of the backing plate in engaged/disengaged positions relative to the backing plate advance belt.

The guide support fitting 62 includes a pair of horizontal stabilizer bars 62*a*, 62*b* spaced to accommodate the advancing belt 34 there between (best seen in FIG. 9). Each of the stabilizer bars 62*a*, 62*b* includes inwardly projecting pins or dowels 72 for riding within and engaging a pair of channel grooves 74*a*, 74*b* formed in the central H-bridge 54 (see FIG. 4) of the transport deck 24. As will be seen in subsequent views and discussion of the track sections 42HD, 42GF, 42IG and 42VD, the channel grooves 74*a*, 74*b* form a continuous loop or path through which the dowels 72 of the guide support fitting 62 travel and, consequently, are guided. While the guide support fitting 62 shows two pairs of laterally projecting pins/dowels 72, it will be appreciated that any guide bushings/rolling elements sleeves/wheels will perform the principle function of guiding the backing plate 32 while minimizing frictional resistance within the guide track or grooves 74*a*, 74*b*. One of can will readily adapt various means for producing a low-friction guide attachment between the backing plate and guide track.

The resilient locking plate 64 includes a vertically sliding handle 76 mounting to the mailpiece support portion 60 of the backing plate 32 and a flexible tongue 76 projecting downwardly between the stabilizer bars 62*a*, 62*b* of the guide support fitting 62. In FIG. 9, an end portion of the flexible tongue 76 engages the teeth 56 of the advancing belt 34. More specifically, the mounting arrangement 80 between the locking plate 64 and the mailpiece support portion 60 is adapted to facilitate flexure of the tongue 76 in one direction, i.e., to provide a soft mount, and to augment the stiffness of the tongue 76 in the other direction, i.e., to provide a rigid mount. As, such, an external force applied in the direction of arrow F1 (best seen in FIG. 10) causes the flexible tongue 78 to deflect away from the guide support fitting 62 and up/over the teeth 56 of the advancing belt 34. In the opposite direction, however, the tongue 78 is structurally supported by a structural web portion 62W of the guide support fitting 62 and is structurally stiffened. Consequently, the backing plate 62 facilitates movement along the advancing belt 34 in one direction F1 as the locking plate 64 deflects (disengaging the teeth 56) and, is rigid or immobile in the other direction, i.e., in the direction of arrow F2, as the locking plate 64 abuts the structural web 62W of the guide support fitting 62.

Additionally, and referring once again to FIGS. 8 and 9, the backing plate 32 may be disengaged from the teeth 56 by displacing the locking plate 64 upwardly, thereby facilitating movement in either direction. More specifically, the mounting arrangement 80 is adapted to facilitate upward motion of the locking plate 64 by a pair of fasteners 80*a*, 80*b* engaging a pair of slot-shaped apertures 82*a*, 82*b* formed in the locking plate 62. Additionally, the locking plate 62 is spring biased downwardly by means of a coil spring 84 disposed in an elongate slot 86 of the mailpiece support portion 60. Consequently, an upward force F3 applied to the handle 76 causes the locking plate 62 to move upwardly against the force of the coil spring 84 and relative to the fasteners 80*a*, 80*b*. With respect to the latter, the slot-shaped apertures 82*a*, 82*b*, facilitate the vertical motion of the locking plate 62 relative to the mailpiece support portion 60 of the backing plate 32. Upon release of the upward force F3, the locking plate 62 is spring-biased downwardly Into engagement with the teeth 56 of the advancing belt 34. Consequently, the backing plate 32 is once again locked In position such that it may be moved in a single direction, i.e., under an applied load F1 which deflects the locking plate 62.

Furthermore, the mailpiece support portion 60 also includes first and second asymmetric arm segments 70R, 70L Integrally formed with and projecting laterally from the central plate segment 68. The first arm segment 70R is co-planar with and projects to one side of the central plate segment 68 while the second arm segment 70L projects to an opposing side of the central plate segment 68, but is vertically asymmetric with respect to the first arm segment 70R. That is, a vertical dimension V separates one of the arm segments 70R, 70L from the other of the arm segments 70R, 70L. This structural difference will be described in greater detail when discussing some of the structural and functional characteristics of the backing plate 32.

After the backing plate 32 traverses the horizontal drive section 42HD (referring once again to FIGS. 2 and 3), the track bends downwardly along a shallow radii curve through the transport deck 24. At the intersection of the track and the transport deck 24 is an opening 90 corresponding to the two-dimensional planar shape of the backing plate 32. That is, the opening 90 includes portions 90R, 90L (see FIG. 3) corresponding to the first and second asymmetric arm segments 70R, 70L of the mailpiece support section 60 of the backing plate 32. As such, a minimal opening 90 through the transport deck 24 minimizes the probability that mailpieces will inadvertently fall through the deck 24 before being diverted/sorted by the transfer belts 28.

Figure 11:
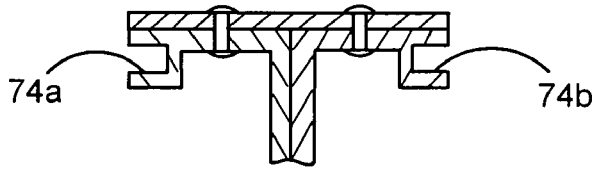
FIG. 11 is a cross-sectional view taken substantially along line 11-11 of FIG. 4
Figure 12:
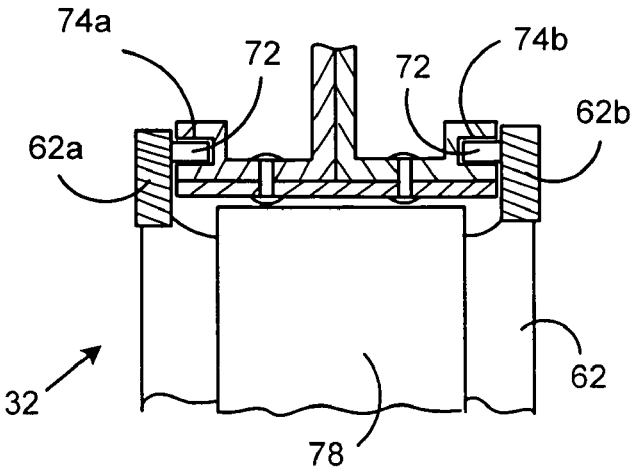
FIG. 12 is a cross-sectional view taken substantially along line 12-12 of FIG. 4

FIGS. 11 and 12 show cross sectional views through the first and second gravity-fed sections 42GV, 42GI, respectively of the closed-loop track. The channel grooves 74*a*, 74*b* of the track serve to guide the backing plates 32 (shown in FIG. 12 only) as they traverse from section to section, e.g., from the horizontal drive section 42HD to the first/second gravity fed sections 42GV, 42GI. More specifically, the vertical and inclined orientation of the sections 42GV, 42GI rely upon gravity to slide the base support fitting 62 of each backing plate 32 in the grooves 74*a*, 74*b*. For simplicity of assembly, the sections 42GV (FIG. 2 shows 42GF) and 42GI (FIG. 2 shows 42IP) may be further segmented into yet smaller subassemblies. For example, sections of track may be assembled by forming butt joint interfaces which are tied together via cross members spanning the interface. In the described embodiment, the inclined section 42GF (FIG. 2 shows 42IP defines an angle θ of between about fifteen degrees (15°) to about twenty-five degrees (25°) with respect to a horizontal line such that a sufficient gravity vector (i.e., a vector component of gravity) is developed to act on the backing plates 32)to self-propel the backing plates to the queuing station 48.

Figure 14:
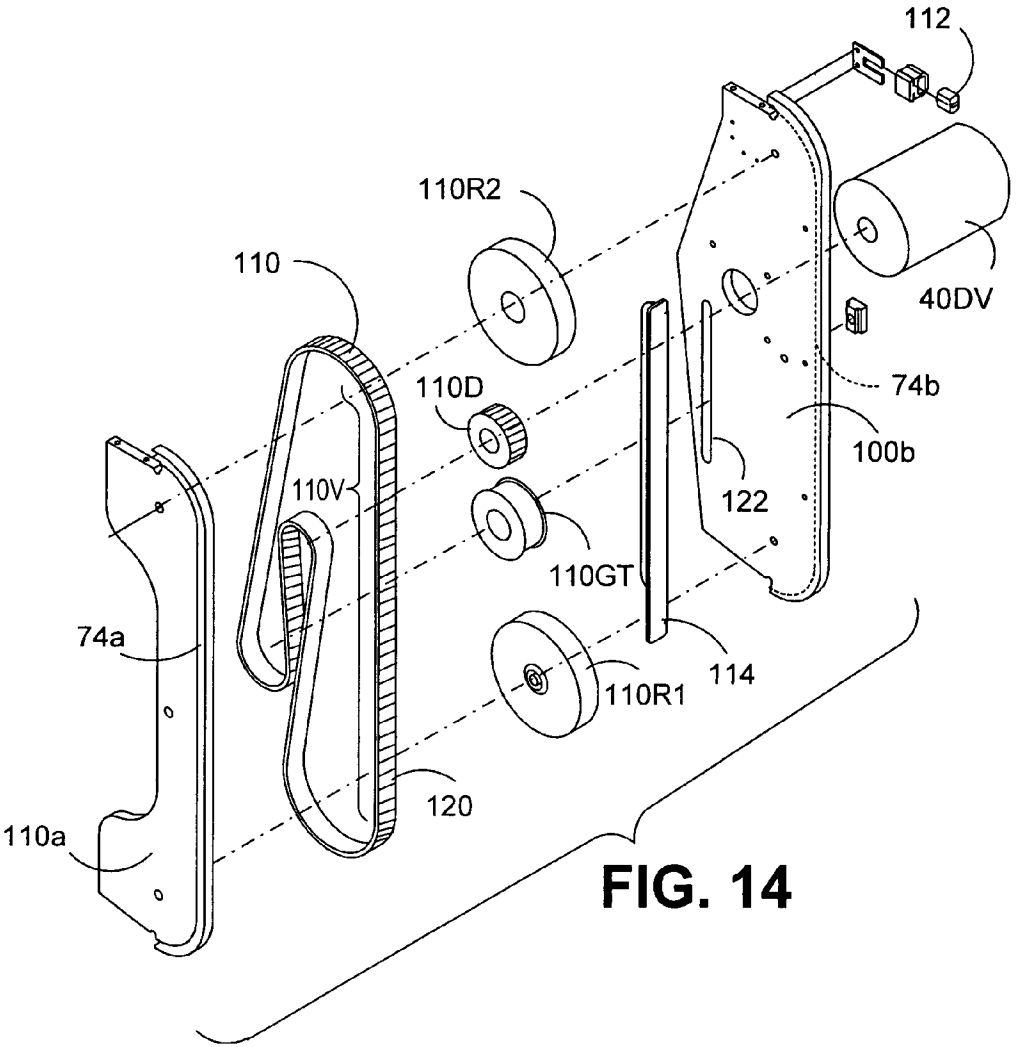
FIG. 14 is an exploded perspective view of the vertical drive assembly depicted in FIG. 13 revealing a backing plate present sensor activating an advance motor for driving the vertical drive assembly.
Figure 13:
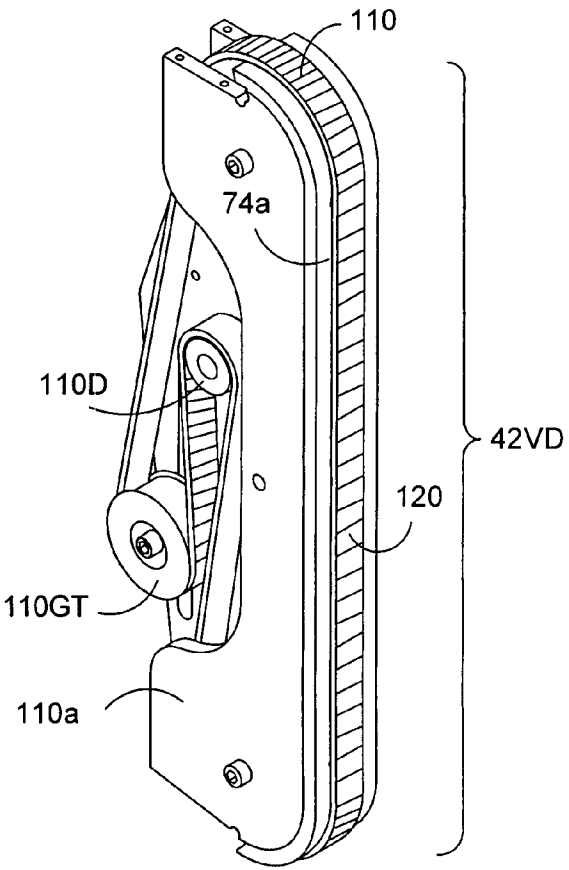
FIG. 13 is an isolated perspective view of the vertical drive assembly for lifting/advancing the backing plates through a horizontal backing plate cut-out of the transport deck and for pre-positioning the backing plates relative to the central advance belt and H-plate.

From the queuing station 48, Individual backing plates 32 are lifted or raised vertically by the vertical drive segment of the 42VD of the track. In FIGS. 2, 13 and 14, the vertical drive section 42VD comprises first and second structural plates 100*a*, l00*b* for supporting there between a drive wheel 110D, a pair of redirecting wheels 110R1, 110R2, a guide/tensioning wheel 110GT, a backing plate sensor 112, and a linear belt support 114. Furthermore, each of the structural plates 100*a*, l00*b* forms one of the channel grooves channel grooves 74*a*, 74*b* of the guide track. That is, an edge of each structural plate l00*a*, 100*b* integrally forms one of the channel grooves 74*a*, 74*b* such that, in combination, they define the track for the guide support fitting 62.

A lifting belt 110 wraps around each of the wheels 110D, 110R1, 110R2, 110GT in a serpentine fashion such that teeth 120 formed on one face of the belt 110 are driven by the drive wheel 110D. Furthermore (shown correctly in FIGS. 13, 14 and incorrectly in FIG. 2) and are externally exposed between the redirecting wheels 110R1, 110R2. Furthermore, the lifting belt 110 includes a vertical segment 110V extending from the queuing station 48 of the prior track section, through the transport deck 24, to the horizontal drive segment 42HD. This segment 110V, in combination with the channel grooves 74*a*, 74*b* of the structural plates 100*a*, 100*b*, defines the vertical drive segment 42VD of The guide track. Moreover, the tension wheel 110GT is mounted within a vertical slot or aperture 122 such that the lifting belt 110 may necessarily traverse a longer path, thereby Inducing tension in the lifting belt 110.

Similar to the teeth 56 of the advancing belt 34, the teeth 120 of the lifting belt 110 engage the tongue 78 (see FIG. 8) of the resilient locking plate 64 to transport the backing plate 32 from the queuing station 48, through the transport deck 24 and to the horizontal drive segment 42HD. Similarly, the opening 90 through the transport deck 24 has a shape corresponding to the two-dimensional planar shape of the backing plate 32. That is, the opening 90 includes portions 90R, 90L corresponding to the first and second asymmetric arm segments 70R, 70L of the mailpiece support section 60 of the backing plate 32. As such, a minimal opening 90 through the transport deck 24 minimizes the potential for mailpieces to inadvertently fall through the deck 24 as an operator loads mailpieces between pairs of backing plates 32

In operation (and referring collectively to the figures) an operator places a mailpiece container (not shown) on the tub shelf 22 in preparation for stacking mailpieces 26 an the transport deck 24 of the mailpiece feeder 20. More specifically, the operator calls for pro-positioning a first backing plate 32 by activating the first a switch e.g., the optical sensor 36-1. which drives the motor 40DV of the vertical drive segment 42DV. As the motor 40DV turns, backing plates 32 are raised, one-by-one, onto the vertical segment 110V of the lifting belt 110. The sensor 112 may be located in the guide track at an upper end portion of the vertical drive segment 42DV to sense the presence or passing of one of the stabilizer bars 62*a* of a guide support fitting 62. The motor 40DV drives the belt 110 for predefined periods of time or a threshold period of time, e.g., two (2) seconds, or until the backing plate sensor 112 identifies the presence of a backing plate 32. If upon activating the optical sensor 36-1, a backing plate 32 is immediately sensed by the sensor 112 already blocking the backing plate sensor 112, then the motor 40DV drives the belt 110 for a first threshold period of time, e.g., two (2) seconds if the backing plate sensor 112 remains blocked. If the backing plate 32 clears the sensor 112, i.e., has past through the transport deck 24 and been prepositioned for the operator, then 112 clears before the threshold period of time (e.g., two (2) seconds) is complete. The motor 40DV then continues to drive and will remain on for a second threshold period of time, e.g., two (2) minutes, or until the backing plate sensor 112 once again, senses the presence of the next backing plate 32. The sensor 112 may be located in the guide track at an upper end portion of the vertical drive segment 42DV to sense the presence or passing of one of the stabilizer bars 62*a* of a guide support fitting 62.

At the same time, the motor 40DH drives the advancing belt 34 along with the other feed magazine belts 44, 46. The operator may continue to stack mailpieces 26 vertically on-edge white the belts 34, 44, 46 are in motion toward the transfer belts 28. The motor 40DH continues to drive the advancing belt 34 along with the other feed magazine belts 44, 46 until the second optical sensor 36-2 is activated by the transfer belt 28 assembly rollers 28. More specifically, the transfer belt assembly 28 is mounted about a vertical axis 28A (see FIG. 3) and adapted to pivot through a shallow angle β, e.g., less than about 10 degrees (10°) in response to a contact pressure applied by the mailpiece stack 26. The pivot displacement of the transfer belt assembly 28 is resisted by a spring biasing mechanism and is measurable by the second optical sensor 36-2. Once the pivot displacement has exceeded a predetermined threshold, e.g., five degrees (5°), the optical sensor 36-2 issues a signal to the second rotary drive motor 40DH to discontinue the driving of the advancing and magazine feed belts 34, 44, 46. It will be appreciated that the transfer belt assembly 28 must maintain a range of contact pressure, i.e., friction forces between the belts 28 and mailpiece stack 26, which allows for individual mailpieces to be singulated and sorted without developing uncontrolled friction forces i.e., forces which could interfere with the mailpiece take-out process.

Alternatively, the motor 40DH may be stopped at any time by the operator through command inputs made via the mailpiece feeder control station 20CS (see FIG. 1). Consequently, the operator can stack mailpieces 26 while the entire backing plate support system is paused/remains motionless. Upon stacking a sufficient number of mailpieces 26, i.e., a number of mailpieces which due to the weight of the mailpieces 26, may cause bending or bowing under its own weight, the operator calls for additional backing plates 32, i.e., by waiving a hand over or interrupting the optical sensor 36. When a backing plate 32 has been pre-positioned, the operator may slide the backing plate 32 toward the mailpiece stack 26, i.e., in a direction which permits flexure of the locking plate 64. As such, the first and second backing plates 32 support the mailpiece stack 26 at opposing ends, i.e., similar to bookend supports, thereby achieving an optimum spacing between the backing plates 32. Should the operator inadvertently apply too much pressure between the backing plates 32, the operator may disengage the teeth 56 of the advancing belt 34 by pulling up on the locking plate 64, against the spring bias force 84 produced by the mounting arrangement 80. Release of the locking plate handle 76 causes the tongue 78 to engage another tooth 56 of the advancing belt 34 as the coil spring 84 of the mounting arrangement 80 urges the locking plate 64 downwardly.

As mentioned in the Background of the Invention, when the spacing between supports is not variable, a greater likelihood exists that too many or too few mailpieces will be stacked between the backing plate supports. If too many mailpieces are stacked, difficulties with removal may result. If too few mailpieces are present, non-optimum orientation may result in mailpiece transfer difficulties, i.e., due to bending/bowing of the mailpieces upon contact with the transfer belts 28.

The operator continues stacking mailpieces by using backing plates 32 to support me on-edge orientation of the mailpieces 26. Various portions of the backing plates 32 are used to support mailpieces 26 of varying size and shape. For example, tall mailpieces 26 will generally be supported by the upper arm 70U of the mailpiece support section while shorter/lower mailpieces are supported by the intermediate or lower arm 70L of the backing plate 32. Once the transport deck 24 is substantially full, the mailpieces 26 will be individually diverted, singulated, and sorted by the transfer belts 28 and sorter stations (not shown) downstream of the feeder 20.

As the mailpieces are diverted, the backing plates 32 continue past the transfer belts 28 through the deck 24. The backing plate support system then employs gravity to transport the backing plates 32, one-by-one down the vertical feed and inclined plane sections 42GV (FIG. 2 shows 42GF), 42GI (FIG. 2 shows 42IP) of the guide track. At the end of the inclined place section 42GI (FIG. 2 shows 42IPF), the backing plates 32 are juxtaposed in the queuing station 48, ready to be engaged and lifted by the vertical drive section 42VD. Once again, command signals are input via the on-demand sensor 36 to preposition each backing plate 32 in preparation for another cycle or run along the guide track of the backing plate support system.

While the invention describes a plurality of guide teeth 56 for engaging each of the backing plates 32, it should be appreciated that the advancing belt 34 may include any structure, element or device suitable for advancing the backing plate 32. Accordingly, the advancing belt may include a plurality of notches, protruding elements, or other structure disposed at regular intervals useful for engaging a backing plate at variable locations along the length of the advancing belt. While the invention relies upon the deflection of a locking plate 64 to enable motion in one direction along the track, other engagement mechanism may be employed to achieve this function. For example, a simple pawl and ratchet arrangement or similar mechanism may be employed to effect freedom of motion in a particular direction. While the guide track is shown as being segmented, it will be appreciated that the track may be continuous, i.e., without requiring breaks in the track or belts.

While three (3) belts are employed to convey mailpieces 26 along the feed path, it will be appreciated that a greater or fewer number of belts may be employed to move the mailpieces along the transport deck 24. Furthermore, while the belts 34, 44, and 46 are all shown to include teeth for driving the respective belt, other mechanisms, e.g., friction drive may be employed to displace/propel the belts along the feed path. Furthermore, while the guide track is shown to have a substantially H-bridge cross-sectional configuration, other geometry may be employed such as a T-, or L-shaped track configuration. Moreover, while the backing plates 32 are shown to include various sections extending to each side of the central or main plate section, a variety of geometric configurations may be employed while remaining within the spirit and scope of the appended claims.

It is to be understood that the present invention is not to be considered as limited to the specific embodiments described above and shown in the accompanying drawings. The illustrations merely show the best mode presently contemplated for carrying out the invention, and which Is susceptible to such changes as may be obvious to one skilled in the art. The invention is intended to cover all such variations, modifications and equivalents thereof as may be deemed to be within the scope of the claims appended hereto.

The invention claimed is:

1. A backing plate support system for a mailpiece feeder mechanism, the feeder mechanism delivering mailpieces vertically, on-edge along a transport deck to a transfer station, comprising:

a guide track disposed along and adjacent to the transport deck;

a plurality of backing plates disposed linearly along the transport deck to accept stacks of mailpieces between pairs of backing plates, each of the backing plates having a guide support fitting at its base, the guide support fitting engaging the guide track and supporting the backing plate in an orthogonal position relative to the transport deck;

an advancing belt disposed adjacent the guide track and adapted to be driven linearly along the transport deck, a mechanism for coupling each backing plate to the advancing belt, the mechanism facilitating movement of the backing support plate relative to the advancing belt in one direction while inhibiting motion thereof in an opposing direction, the coupling mechanism facilitating variable spacing between the pairs of backing plates when mailpieces are stacked therebetween, a track including a horizontal drive section, first and second gravity feed sections and a vertical drive section, the horizontal drive section disposed adjacent to and aligned with the drive track of the transport deck for conveying mailpieces between pairs of backing plates to a transfer belt assembly, the vertical drive section for raising each of the backing plates through the transport deck to preposition each of the backing plates for use in the horizontal drive section, and the first and second gravity feed sections for conveying the backing plates from the horizontal drive section to the vertical drive section, the gravity feed sections employing gravity to convey the backing plates from the horizontal to the vertical drive sections.

2. The backing plate support system according to claim 1 further comprising:

a controller, responsive to an operator command, operable to preposition each of the backing plates relative to the mailpiece stack.

3. The backing plate support system according to claim 1 further comprising:

magazine feed belts disposed to each side of the advancing belt to transport the mailpieces along the transport deck.

4. The backing plate support system according to claim 1 wherein each of the backing plates have a two dimensional shape and wherein the transport deck includes at least one opening having a shape corresponding to the two dimensional shape of one of the backing plates.

5. The backing plate support system according to claim 3 further comprising an H-shaped guide plate disposed in combination with the transport deck, the H-shaped guide plate having upper and lower guide channels formed on each side of a central web, and wherein the advancing and magazine feed belts are each guided within the upper and lower guide channels of the guide plate.

6. The backing plate support system according to claim 2 further comprising a first rotary drive motor for driving the advancing belt and a first sensor for issuing command signals to the controller and driving the rotary drive motor, the first sensor employing an optical switch responsive to a hand motion of an operator.

7. The backing plate support system according to claim 3 further comprising a drive motor, and wherein each of the belts are driven by a common drive shaft having equal diameter drive wheels, the drive wheels conveying each of the belts at the same linear velocity along the transport deck.

8. The backing plate support system according to claim 1 wherein the advancing belt includes a plurality of teeth disposed along a face surface of the belt, and wherein the coupling mechanism includes a resilient locking plate mounting to a face surface of the guide plate, the resilient locking plate, furthermore, having a flexible tongue for engaging the teeth of the advancing belt, the flexible tongue facilitating motion of the backing plate in one direction and resisting motion thereof in the opposing direction.

9. The backing plate support system according to claim 8 wherein the coupling mechanism includes a mounting arrangement between the resilient locking plate and a mailpiece support portion of the guide plate, the mounting arrangement facilitating upward motion of the locking plate in a first operating mode to disengage the flexible tongue from the teeth of the advancing belt thereby facilitating movement of the guide plate relative to the advancing belt, and biasing the flexible tongue downwardly, in a second operating mode, to engage the teeth thereby locking the position of the guide plate relative to the advancing belt.

10. The backing plate support system according to claim 1 wherein the backing plate includes first and second asymmetric arm segments integrally formed with and projecting laterally from a central plate segment of the backing plate, the first arm segment being co-planar with and projecting to one side of the central plate segment and, the second arm segment being co-planar with and projecting to an opposing side of the central plate segment.

11. A feeder mechanism for delivering mailpieces vertically, on-edge along a transport deck to a transfer station, comprising:

a backing plate support system having a plurality of variably spaced backing plates disposed linearly along the transport deck to accept and support stacks of vertically oriented mailpieces between pairs of backing plates, the backing plates each being driven linearly along the transport deck to convey the mailpieces, to the transfer station, the variably spaced backing plates, furthermore, being driven by an advancing belt disposed linearly along the transport deck, and passing through and below the transport deck upon passing a transfer belt assembly;

a first sensor operative to preposition each of the backing plates for transfer along the advancing belt, the first sensor employing an optical switch responsive to a hand motion of an operator, the transfer belt assembly for singulating each of the mailpieces upon arriving at the transfer station, the transfer belt assembly pivotable about an axis in response to contact with the vertically stacked mailpieces, and spring biased in a direction opposing the pivot motion, and a second sensor operative to drive the advancing belt toward the transfer belt assembly, the second sensor furthermore responsive to the pivot motion displacement of the transfer belt assembly, whereby pivot motion of the transfer belt assembly less than a threshold magnitude the drives the advancing belt and stacked mailpieces against the transfer belt assembly and pivot motion in excess of a threshold magnitude pauses the drive motion of the advancing belt as mailpieces are singulated and transferred from the feeder mechanism.

12. The feeder mechanism according to claim 11 wherein the backing plate support system further includes:

a guide track including a horizontal drive section disposed along and adjacent to the transport deck, first and second gravity feed sections, and a vertical drive section, the horizontal drive section including the advancing belt for conveying mailpieces to the transfer belt assembly, the vertical drive section raising each of the backing plates through the transport deck for pre-positioning each along the horizontal drive section, and the first and second gravity feed sections for conveying the backing plates from the horizontal drive section to the vertical drive section, the gravity feed sections employing gravity to convey the backing plates from the horizontal to the vertical drive sections.

13. The feeder mechanism according to claim 11 wherein each of the backing plates have a two dimensional shape and wherein the transport deck includes at least one opening having a shape corresponding to the two dimensional shape of one of the backing plates.

14. The feeder mechanism according to claim 11 further comprising magazine feed belts disposed to each side of the advancing belt to transport the mailpieces along the transport deck.

15. The feeder mechanism according to claim 14 further comprising an H-shaped guide plate disposed in combination with the transport deck, the H-shaped guide plate having upper and lower guide channels formed on each side of a central web, and wherein the advancing and magazine feed belts are each guided within the upper and lower guide channels of the guide plate.

16. The feeder mechanism according to claim 11 wherein the advancing belt includes a plurality of teeth disposed along a face surface of the belt, and further comprising a coupling mechanism including a resilient locking plate mounting to a face surface of the guide plate, the resilient locking plate, furthermore, having a flexible tongue for engaging the teeth of the advancing belt, the flexible tongue facilitating motion of the backing plate in one direction and resisting motion thereof in the opposing direction.

17. The feeder mechanism according to claim 16 wherein the coupling mechanism includes a mounting arrangement between the resilient locking plate and a mailpiece support portion of the guide plate, the mounting arrangement facilitating upward motion of the locking plate in a first operating mode to disengage the flexible tongue from the teeth of the advancing belt thereby facilitating movement of the guide plate relative to the advancing belt, and biasing the flexible tongue downwardly, in a second operating mode, to engage the teeth thereby locking the position of the guide plate relative to the advancing belt.

18. The feeder mechanism according to claim 11 wherein the backing plate includes first and second asymmetric arm segments integrally formed with and projecting laterally from a central plate segment of the guide plate, the first arm segment being co-planar with and projecting to one side of the central plate segment and, the second arm segment being co-planar with and projecting to an opposing side of the central plate segment.

19. The feeder mechanism according to claim 18 wherein the transport deck includes at least one opening having a shape corresponding to the first and second asymmetric arm segments of the backing plates.

* * * * *